United States Patent [19]

Habbe et al.

[11] Patent Number: 4,856,160

[45] Date of Patent: Aug. 15, 1989

[54] BULLET WITH REVERSE TAPER INTERLOCK JACKET AND METHOD OF MANUFACTURING THE BULLET

[75] Inventors: Randall G. Habbe, Pocahantas; Herman N. Bockstruck, Alton, both of Ill.

[73] Assignee: Olin Corporation, Stamford, Conn.

[21] Appl. No.: 156,157

[22] Filed: Feb. 16, 1988

[51] Int. Cl.[4] ..... B21K 21/06

[52] U.S. Cl. ..... 29/1.23; 29/1.22

[58] Field of Search ..... 29/1.2, 1.22, 1.23; 102/514, 518

[56] References Cited

U.S. PATENT DOCUMENTS

| | | | |
|---|---|---|---|
| 2,321,344 | 6/1943 | Whipple | 29/1.23 |
| 2,765,738 | 10/1956 | Frech, Jr. | 29/1.23 X |
| 3,349,711 | 10/1967 | Darigo et al. | 29/1.23 X |

*Primary Examiner*—Timothy V. Eley

*Attorney, Agent, or Firm*—Bruce E. Burdick

[57] ABSTRACT

A reverse taper jacketed bullet has a tubular jacket in the form of a continuous wall defining a cavity and a one-piece core disposed in the jacket cavity. The jacket has opposite heel and mouth portions and an intermediate portion interconnecting the heel and mouth portions. The jacket wall is thicker at the intermediate portion than at either the heel or mouth portion thereof so as to define a reverse taper configuration along the intermediate and heel portions which bulges inwardly at the intermediate portion interior relative to the heel portion interior. The reverse taper configuration provides an inside diameter at the jacket intermediate portion that is less than at the jacket heel portion and in such manner produces a constriction that interlocks the lead core and jacket together. The reverse taper configuration of the jacket wall is formed in final draw step by insertion of a punch having an hour glass shaped or reverse taper configured end portion into an elongated predrawn cup. The final drawing produces a thicker wall at the location of the intermediate portion of the jacket than at the location of the heel or mouth portion thereof. Withdrawal of the punch from the jacket causes the thicker intermediate wall portion to bulge outwardly at the exterior of the jacket. Then, the jacket wall is drawn in to provide a generally uniform outside diameter that causes the thicker intermediate wall portion to bulge inwardly at the interior of the jacket.

13 Claims, 1 Drawing Sheet

BULLET WITH REVERSE TAPER INTERLOCK JACKET AND METHOD OF MANUFACTURING THE BULLET

BACKGROUND OF THE INVENTION

1. Field of the Invention

The present invention generally relates to rifle bullets and, more particularly, is concerned with a bullet having a jacket with a reverse taper configuration providing an interlock with the core of the bullet and with a method of manufacturing the reverse taper jacketed bullet.

2. Description of the Prior Art

A satisfactory big game bullet must achieve several competing objectives. The bullet must fly accurately at high velocity and penetrate the hide of the game without creating a large surface wound. Thereafter, the bullet must stop abruptly in the game with minimal fragmentation to deliver maximum shock effect to the game while preserving its meat and hide.

Conventional game bullets, being similar in their general make-up to the bullet disclosed in U.S. Pat. No. 3,345,949 to J. A. Nosler, are composed of a core of lead enclosed in a jacket having a generally cylindrical body with a thin ductile wall and a forward tapered end through which extends the forward end of the lead core. When a bullet of this general composition hits the game, it will usually achieve satisfactory penetration, but the tendency is for its lead core to move forward and "wash" off, fragment and/or separate from its jacket as the jacket tears open and starts to peel back into a mushroom-shaped configuration. The end result is that a substantial proportion of the weight of the bullet is lost as it travels through the game which reduces the energy of the shock effect on the game and distributes fragments of lead throughout a large region of the game. Attempts to better contain the lead core by hardening the jacket have the disadvantage of preventing the jacket from mushrooming properly, which frequently results in the bullet passing on through the game and thereby failing to transfer most of its energy to it.

One bullet design which has attempted to overcome some of the above-mentioned problems of conventional bullets is the partitioned jacket bullet disclosed in U.S. Pat. No. 3,003,420 and 3,069,748 which are also issued to J. A. Nosler. In this design, the lead core is divided into front and rear parts and the jacket has an intermediate transverse partition dividing it into front and rear pockets which contain the respective parts. While the integral partition generally holds the rear core part in place after impact as the jacket tip ruptures and curls outward and back into the mushroom configuration, the front core part, like the lead core of the conventional bullet, tends to separate from the rest of the bullet and can often disintegrate and disperse throughout the adjacent regions of the game, reducing the energy of the shock effect which can be delivered by the bullet to the game. Although the Nosler partition bullet sometimes has advantage over the conventional bullet in terms of weight retention, this advantage is more than offset by the disadvantages of the partition bullet in terms of the difficulty, complexity and costliness of its manufacturing process.

Consequently, in view of the above-described shortcomings in the Nosler partition bullet, a need still remains to come up with a bullet design which has improved performance in terms of diameter increase and retained weight characteristics during upsetting or mushrooming of the bullet and to come up with a method of manufacturing the bullet which is relatively simple and is reasonable in cost.

SUMMARY OF THE INVENTION

The present invention provides a bullet with a reverse taper jacket and a method of manufacturing the bullet which both satisfy the aforementioned needs and which makes use of conventional bullet forming equipment with just minimal tooling and process changes.

In the method of manufacturing the bullet, a final draw of a predrawn elongated cup to form the bullet jacket is performed so as to produce a thicker wall at an intermediate portion of the jacket than at opposite heel and mouth portions thereof with the thicker intermediate wall portion bulging outwardly at the exterior of the jacket. Then, a generally uniform outside diameter is produced on at least the intermediate and heel portions of the jacket so as to cause the thicker intermediate wall portion to bulge inwardly at the interior of the jacket.

More particularly, a punch having an hour glass shaped, or reverse taper configured, end portion is inserted into the long cup and then withdrawn therefrom to perform the final draw of the cup to the desired shape with a slightly bulging center for use in subsequent formation of the bullet with reverse tapered bullet jacket. Next, the bullet jacket wall is drawn in to provide the jacket with the generally uniform outside diameter and an inwardly bulged internal wall by pushing the jacket through an annular die.

After the jacket at its mouth portion is trimmed to the desired length, a one-piece core having a cylindrical or other desired shape preferably with a tapered nose is then inserted into the jacket. A nose forming operation is used to properly seat the core in the jacket and deform the core body against the bulged internal wall and deform the tapered nose into a generally pointed configuration. Also, the mouth of the jacket is folded in to provide a tapered configuration which conforms to the tapered and pointed core nose. The outer end of the jacket mouth is preferably open, allowing the pointed end of the core nose to extend through and be exposed beyond the outer end of the jacket mouth.

The bullet of the present invention thus formed by the method of the present invention has an elongated tubular jacket in the form of a continuous wall defining a cavity and a one-piece continuous core disposed in the cavity of the jacket. The jacket has a heel portion at one end, a mouth portion at an opposite end and an intermediate portion interconnecting the heel and mouth portions. The continuous wall of the jacket is thicker at the intermediate portion than at either the heel or mouth portion of the jacket. The wall thickness of the intermediate jacket portion is not uniform but is at a maximum at approximately the center of the intermediate portion and diminishes to a minimum at the opposite ends of the intermediate portion. This change in wall thickness defines a reverse taper configuration at the intermediate and heel portions of the jacket.

Given the substantially uniform outside diameter of the bullet jacket at the exterior of the heel and intermediate portions thereof, the reverse taper configuration causes the intermediate jacket portion at the interior thereof to bulge inwardly relative to the interior of the heel jacket portion to provide the jacket with an inside diamater at the center thereof that is less than at the heel portion of the jacket. The inwardly bulging thicker intermediate wall portion of the jacket together with the thinner heel wall portion thereof produces a constriction that interlocks the rear portion of the core and jacket together.

Although the thicker intermediate wall portion of the jacket will not totally eliminate core slippage within the jacket upon target impact, it does substantially eliminate separation of the jacket and core. Also, the thicker intermediate wall portion of the jacket provides a maximum amount of metal to slow the tearing jacket during upset (bullet expansion) which with a proper jacket mouth and point design would improve the diameter increase and retained weight characteristics of the upsetting bullet.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
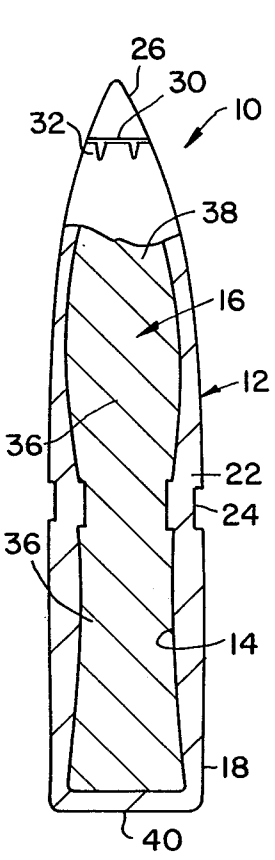
FIG. 1 is a longitudinal sectional view of the improved bullet of the present invention, showing the bullet with a jacket having a reverse taper interlock with the core of the bullet.

Referring now to the drawings, and particularly to FIG. 1, there is shown a reverse taper jacketed bullet constructed in accordance with the present invention and being generally designated by the numeral 10. The bullet 10 basically has an elongated tubular jacket 12 in the form of a continuous wall defining a cavity 14 and a one-piece continuous core 16, composed preferably of lead, disposed in the cavity 14 of the jacket 10.

More particularly, the jacket 10 has a closed heel portion 18 at a lower end, an open mouth portion 20 at an opposite upper end and an intermediate portion 22 extending between and interconnecting the heel and mouth portions 18, 20. The jacket wall is thicker at the intermediate portion 22 than at either the heel or mouth portions 18, 20 of the jacket 12. The wall thickness of the intermediate jacket portion 22 is not uniform but is at a maximum at approximately the center of the intermediate portion and diminishes to a minimum at the opposite ends of the intermediate portion where the intermediate portion 22 merges respectively with the heel and mouth portions 18, 20.

This change in wall thickness of the jacket 12 defines a reverse taper configuration at the intermediate and heel portions 22, 18 of the jacket 12. Given the substantially uniform outside diameter of the bullet jacket 12 at the exterior of the heel and intermediate portions 18, 22, the reverse taper configuration means that the intermediate jacket portion 22 at the interior thereof bulges inwardly relative to the interior of the heel jacket portion 18 to provide the jacket 12 with an inside diameter at the center thereof that is less than at the heel portion 18 of the jacket 12. The inwardly bulging thicker intermediate wall portion 22 of the jacket 12 together with the thinner heel wall portion 18 thereof produces a constriction or the reverse taper configuration that provides an interlocking of the lead core 16 and the jacket 12 which holds them together. The core 16 has a cylindrical configuration which when pressed into the jacket will assume a reverse taper configuration which complements that of the interior of the jacket 12 at its intermediate and heel portions 18, 22.

Also, a roll crimp (or "bullet krurl") 24 is preferably formed about the exterior of the center of the intermediate jacket portion 22 for facilitating attachment of the completed bullet 10 to a cartridge (not shown) and secondarily for providing additional inward projection of the already inwardly bulged portion of intermediate wall portion 22. The upper end of the jacket mouth 20 is open and a pointed end 26 of a nose 28 of the core 16 extends through and is exposed above the jacket mouth upper end. The core nose 28 overlaps the upper edge 30 of the jacket mouth 20. Notches 32 in the jacket 12 extending downwardly from the mouth upper edge 30 enhance controlled upsetting of the jacket upon impact of the bullet with the target.

Figure 2:
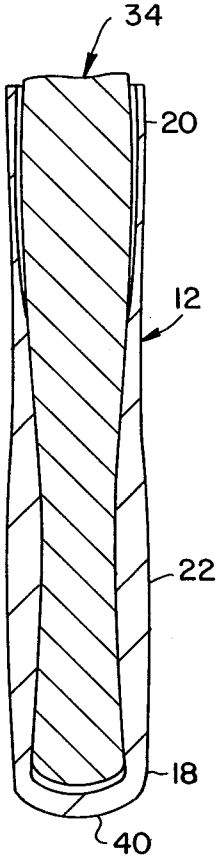
FIG. 2 is a longitudinal sectional view of the bullet jacket after formation by insertion of the final draw punch just before expansion by removal of the punch.
Figure 3:
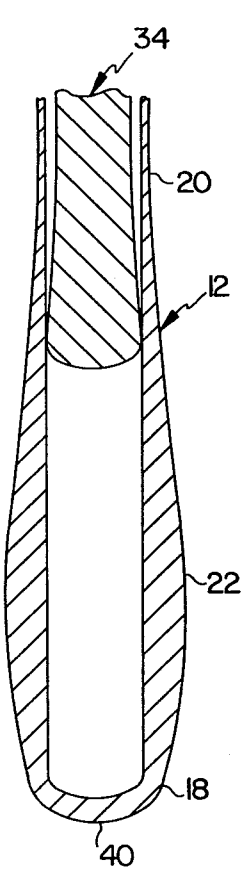
FIG. 3 is a longitudinal cross sectional view of the outwardly bulged jacket just after removal of the final draw punch.

In the method of manufacturing the bullet 10, an initial succession of conventional deep draw steps (not shown) are carried out to progressively elongate a relatively thick-walled shallow cup into a relatively thin-walled longer cup. Turning now to FIGS. 2 to 5, there is shown the final steps of the method of the present invention to complete manufacture of the bullet 10. First, a punch 34 having an hour glass shaped, or reverse taper configured, end portion is inserted into the long predrawn (partially drawn) cup being supported by suitable conventional dies (not shown) to perform a final draw thereof to form the bullet jacket 12. Due to the jacket metal being drawn against the hour glass shaped punch 34, the final draw of the predrawn cup by the punch 34 produces a thicker inwardly bulged wall at the intermediate portion 22 of the wall of the bullet jacket than at the heel or mouth portions 18, 20 of the jacket, as seen in FIG. 2. By way of example, the average thickness at approximately the center or thickest region of the intermediate portion 22 is 0.045 inch versus a thickness of 0.031 inch at the heel portion 18 of the jacket 12. Withdrawal of the punch 34 from the jacket 12 causes the thicker intermediate wall portion 22 to bulge outwardly at the exterior of the jacket 12, as seen in FIG. 3.

Figure 4:
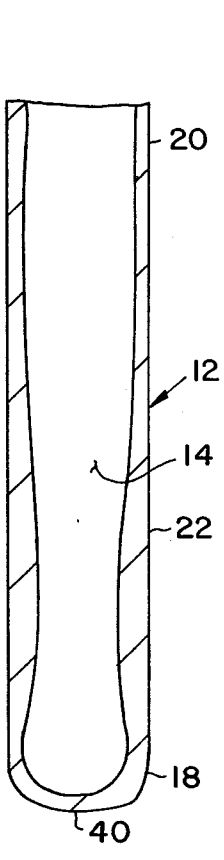
FIG. 4 is a longitudinal sectional view of the bullet jacket after completion of the jacket wall draw-in operation.

However, it is desired that the thicker intermediate wall portion 22 bulge inwardly instead of outwardly and that the outside of the intermediate and heel portions 22, 18 of the jacket have a generally uniform diameter. Therefore, next, and as an additional step to the conventional jacket draw operations, the wall of the bullet jacket 12 is drawn in by pushing (or pulling) the jacket through a conventional annular die (not shown) which places the wall in tension. Such operation causes the jacket 12 to grow slightly in length and decrease slightly in thickness. For instance, the average wall thickness of the intermediate jacket portion 22 now measures 0.0435 inch versus 0.0315 inch at the heel portion 18 of the jacket. Nonetheless, as seen in FIG. 4, as is desired, the jacket 12 is now provided with a generally uniform outside diameter and the thicker intermediate wall portion 22 is caused to bulge inwardly at the interior of the jacket.

Figure 5:
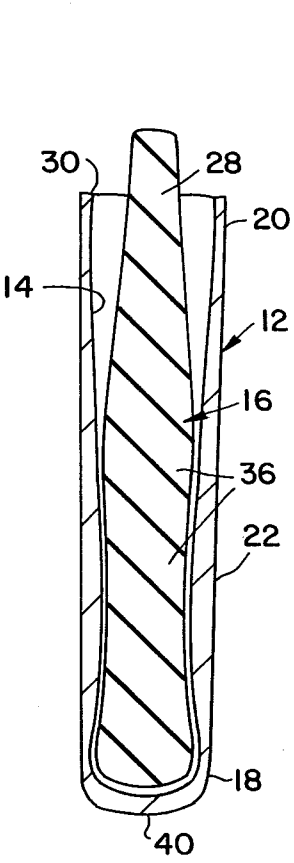
FIG. 5 is a longitudinal section view of the bullet jacket after the jacket has been trimmed and the lead core seated therein.

The jacket 12 is now trimmed by use of a suitable conventional device (not shown) to the desired final length seen in FIG. 5. After trimming is completed, the one-piece lead core 16 having a right cylindrical body 36 and a tapered nose 28 is then inserted into the jacket 12. A nose and body forming operation using suitable conventional dies (not shown) is carried out to properly seat the core 16 in the cavity 14 of the jacket 12 and to deform the tapered nose 28 into the final desired nose configuration 38.

Also, the mouth portion 20 of the jacket 12 is folded in during the nose forming operation to provide a tapered configuration which conforms to the ogive (the generally tapered and pointed configuration of the final core nose) 38. As mentioned above, the upper edge 30 of the jacket mouth 20 is open, allowing the pointed end 26 of the final core nose 28 to extend through and be exposed above the jacket mouth 20.

It should be understood that instead of being flat, the base 40 on the heel portion 18 of the jacket 12 could alternatively be of concave or boat tail shape. The jacket 12 can be composed of copper, copper alloy, steel, clad steel or other similar type materials. In addition to being open point, the nose 28 can have a cap of aluminum, plastic or other similar material affixed thereon. As mentioned earlier, the core 16 can be composed of lead, lead alloy or other similar type material.

It is thought that the reverse taper jacketed bullet and method of manufacturing the bullet of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely a preferred or exemplary embodiment thereof.

We claim:

1. A method of manufacturing a bullet, which comprises the steps of:

(a) performing a final draw of a predrawn elongated cup to form a bullet jacket having opposite heel and mouth portions and an intermediate portion therebetween so as to produce a thicker wall at the intermediate portion than at the opposite heel and mouth portions with the thicker intermediate wall portion bulging outwardly at the exterior of the jacket; and (b) producing a generally uniform outside diameter on at least the intermediate and heel portions of the jacket so as to cause the thicker intermediate wall portion to bulge inwardly at the interior of the jacket.

2. The method as recited in claim 1, wherein said final draw performing step includes inserting a punch having an hour glass shaped end portion into the predrawn cup to form the jacket.

3. The method as recited in claim 2, wherein said final draw performing step further includes withdrawing the punch from the jacket.

4. The method as recited in claim 1, wherein said final draw performing step includes inserting a punch having a reverse taper configured end portion into the predrawn cup to form the jacket.

5. The method as recited in claim 4, wherein said final draw performing step further includes withdrawing the punch form the jacket.

6. The method as recited in claim 1, wherein said uniform outside diameter producing step includes moving the jacket through an annular die.

7. The method as recited in claim 1, further comprising:

trimming the jacket at its mouth portion to a desired length.

8. The method as recited in claim 7, further comprising:

inserting into the jacket a one-piece core and forming the core into a form having a tapered nose and an hour glass shaped body substantially complementary to and disposed against the interior configuration of the intermediate and heel portions of the jacket.

9. The method as recited in claim 8, wherein said core forming step further comprise the step of:

performing a bullet nose forming operation to set the core into the jacket and deform the tapered core nose into a generally pointed configuration.

10. The method as recited in claim 9, further comprising:

folding the mouth of the jacket inwardly to provide a tapered configuration which conforms to the tapered and pointed core nose, with an outer end of the jacket mouth remaining open to allow the pointed end of the core nose to extend through and be exposed above the outer end of the jacket mouth.

11. The method as recited in claim 7, further comprising:

inserting into the jacket a one-piece core having a tapered nose and a reverse taper configured body substantially complementary to the interior configuration of the intermediate and heel portions of the jacket.

12. The method as recited in claim 11, further comprising:

performing a bullet nose forming operation to set the core into the jacket and deform the tapered core nose into a generally pointed configuration.

13. The method as recited in claim 12, further comprising:

folding in the mouth of the jacket to provide a tapered configuration which conforms to the tapered and pointed core nose, with an outer end of the jacket mouth remaining open to allow the pointed end of the core nose to extend through and be exposed above the outer end of the jacket mouth.

* * * * *